United States Patent [19]

Lavery

[11] Patent Number: 4,974,771

[45] Date of Patent: Dec. 4, 1990

[54] CAN CARRIER WITH INTEGRAL HANDLE

[75] Inventor: John J. Lavery, Chicago, Ill.

[73] Assignee: International Paper Company, Purchase, N.Y.

[21] Appl. No.: 917,632

[22] Filed: Oct. 7, 1986

[51] Int. Cl.[5] ..... B65D 5/46

[52] U.S. Cl. ..... 229/117.13; 206/141; 206/427

[58] Field of Search ..... 229/52 B, 40, 52 BC, 229/117.13; 206/427, 434, 141

[56] References Cited

U.S. PATENT DOCUMENTS

| | | | |
|---|---|---|---|
| 2,598,051 | 5/1952 | Guyer et al. | 229/52 B |
| 3,112,856 | 12/1963 | MacIntosh et al. | 229/52 B |
| 4,340,170 | 7/1982 | Montealegre | 229/52 B |
| 4,382,510 | 5/1983 | Gaffney | 229/52 B |
| 4,463,852 | 8/1984 | Stone | 206/141 |
| 4,478,334 | 10/1984 | Graser | 229/52 B |
| 4,558,816 | 12/1985 | Wood | 229/52 B |

FOREIGN PATENT DOCUMENTS

| | | | |
|---|---|---|---|
| 712905 | 7/1965 | Canada | 229/52 B |
| 1602857 | 11/1981 | United Kingdom | 229/52 B |

*Primary Examiner*—Gary E. Elkins

*Attorney, Agent, or Firm*—Michael J. Doyle; Walt Thomas Zielinski

[57] ABSTRACT

A paperboard carton in the form of a rectangular parallelpiped and formed by gluing and folding a scored, one-piece paperboard blank. The top panel or wall of the carton carries a series of perforated/cut lines which define a finger insertable carrying handle upon pushing inwardly by the user. A pair of thumb holes is provided on the top carton panel with each hole equidistantly spaced from the handle recess in the top panel. The carton may be carried by inserting a thumb in one of the thumb holes and the remaining fingers in the handle, thereby defining two lifting and carrying areas for the convenience of the user. The carton is particularly useful as a container for cans. In a modification, strain-relieving cuts are provided in the side walls, these cuts intersecting curved portions of finger perforated lines in the top panel.

3 Claims, 3 Drawing Sheets

CAN CARRIER WITH INTEGRAL HANDLE

BACKGROUND OF THE INVENTION

This invention relates in general to cartons for carrying a plurality of cans such as soft drink or other beverage cans. The prior art is aware of a variety of constructions relating to can carriers, many of which are fashioned from one or more blanks of paperboard, the paperboard being suitably scored, glued and folded to form a carton or a carrier. Many such cartons also include handle elements, with such handle elements either being defined as an integral part of the carton or by an auxiliary element.

SUMMARY OF THE INVENTION

According to the practice of this invention, a can carrier or carrier or carton is fashioned from a single blank of stiff, resilient and foldable sheet material such as paperboard. The blank is provided with cut lines, perforation lines and fold lines and is thereafter glued together after the carton has been squared up or erected and filled with its contents, typically being soft drink cans. The carrier of this invention is initially formed into a tube which is then collapsed and shipped to the packager. The cartons are erected, filled with cans, and their ends are then closed to thereby define a completed carrier. The carrier is in the general form of a rectangular parallelepiped, i.e., is a brick shape, and its upper, horizontal wall is provided with means for forming both a finger receiving recess or aperture and a thumb receiving recess or aperture. Two such thumb receiving aperture forming elements are formed in the top of the carton, so that either thumb of either hand may be placed in one of them, with the remaining fingers being placed at a central or finger-receiving aperture.

DESCRIPTION OF THE INVENTION

Figure 1:
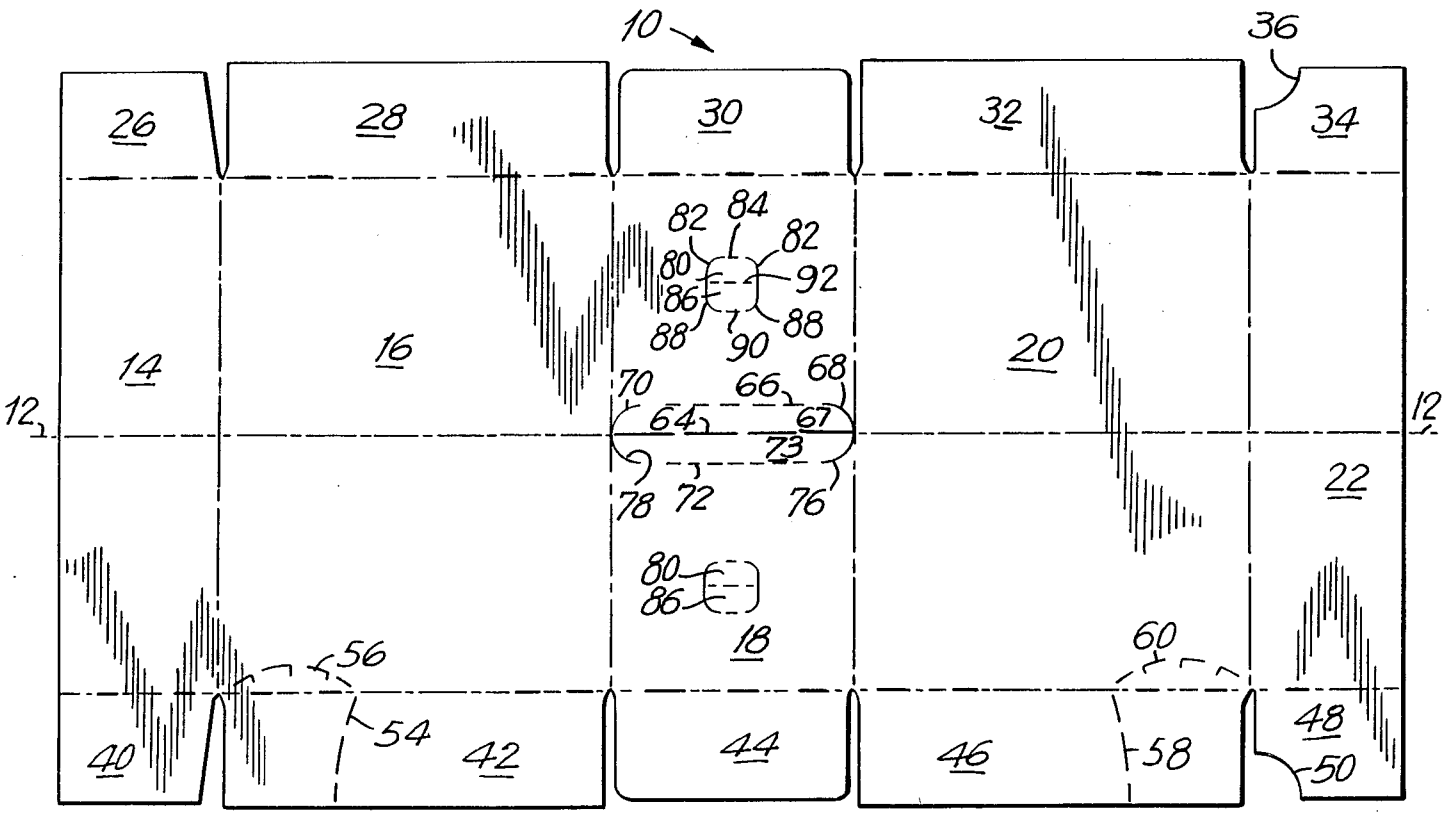
FIG. 1 is a plan view of the blank from which the can carrier or carton of this invention is formed.

Referring now to FIG. 1 of the drawings, the numeral 10 denotes generally the one-piece, integral, generally rectangular paperboard blank from which the can carrier or carton of this invention is formed. The numeral 12 denotes the longitudinal axis of the blank. The numerals 14, 16, 18, 20 and 22 each denote a panel, foldably or hingedly coupled to its neighboring panel by means of the indicated and vertically extending fold lines. These panels thus form a series of side or wall-forming panels. The numerals 26, 28, 30, 32 and 34 each denote an end closure forming panel secured to the upper end (as viewed at FIG. 1) of a corresponding main body panel 12, 16, etc. Similarly, numerals 40, 42, 44, 46 and 48 each denote a respective opposite end forming panel secured to a respective one of the main body panels 14, 16 and 18. The numerals 36 and 50 denote arcuate cuts which cooperate with perforations 54, 56, 58 and 60 to form a can dispensing element of the can carrier carton of this invention. This dispensing element is known in the art and forms no part of this invention. Referring now more particularly to panel 18 of blank 10, this panel is termed a handle panel or upper panel because it is the uppermost panel in the completed and fully erected, filled carrier of this invention and contains handle-forming elements now to be described.

The numeral 64 denotes a perforated cut line extending completely across the width of handle panel 18, partially coincident with axis 12, and extending between the indicated hinge lines which connect adjacent panels 16 and 20 to panel 18. For reasons which will soon become apparent, cut line 64 is termed a finger cut line. The numeral 66 denotes a perforated line which extends parallel to cut line 64 and whose ends terminate in bent, cut line segments 68, 70, the latter extending all the way down to meet a respective end of cut line 64. For reasons which will soon become apparent, perforated line 66 is termed a perforated finger line. The numeral 72 denotes a second perforated finger line, terminating in cut, bent portions 76 and 78, each of which curves upwardly and meets a respective end of cut line 64. The numerals 67 and 73 denote finger flaps. The numerals 80 and 86 denote thumb panels for reasons which soon become will apparent. Panel 80 is defined by cut lines 82, while thumb panel 86 is defined by cut lines 88. Segments 84 and 90 of panel 18 are not cut and define a hinge or flap axis for the respective flaps 80 and 86. The numeral 92 denotes a perforated line extending between the parallel segments of lines 82 and 88.

To form the carton of this invention from the blank 10 of FIG. 1, the free edges of flaps 14 and 22 are glued together so that the blank assumes the form of a tube. The tube may be formed in its erected position or in a substantially collapsed position. After formation of the tube, it is shipped in a collapsed state to a packager of cans for erecting and filling and final completion of the carton. Typically, an adhesive may be applied to the upper right-hand surface of panel 22, or to the lower left-hand surface of panel 14, with these portions being secured in overlapping relationship.

Figure 2:
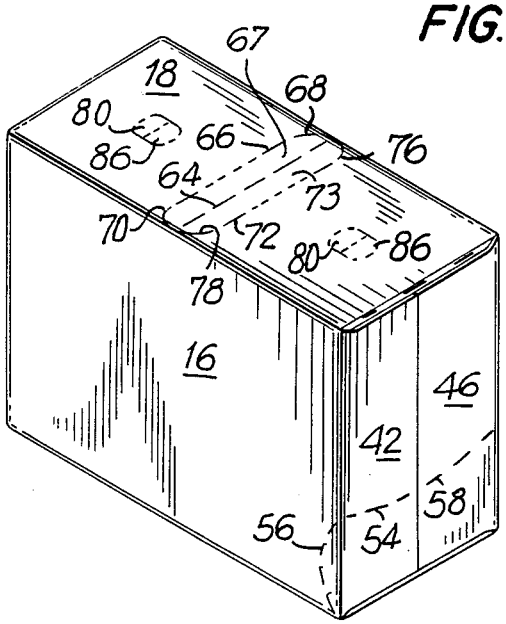
FIG. 2 is a perspective view of the can carrier or carton of this invention shown in its fully erected and filled condition.

Referring now to FIG. 2 of the drawings, the carrier is shown in its erected and filled condition, typically with twelve soft drink cans placed in it, with the longitudinal axis of each can being perpendicular to a side wall or side panel 16, 20 of the carton. In use by the consumer, the fingers of the user are pushed down onto the central part of handle panel 18, to thereby completely break perforated cut line 64 and cause a complete separation between finger flap elements 67 and 73, with one of these elements, depending upon which hand is used and in which direction the fingers extend, forming a double thickness of paperboard immediately above the fingers of the user. The thumb of the user is placed in either of the upper or lower (as viewed in FIG. 1) thumb receiving flap elements 80, 86, with these elements being hinged downwardly about respective hinge axes 84, 90. Thus, either one of the pair of thumb receiving, thumb aperture forming cuts and perforated lines on handle panel 18 may be employed to assist in lifting the carton.

The reader will now readily visualize that the construction of this invention enables the user to lift the can carrier from two distinct lifting and carrying areas, thereby resulting in greater convenience and less strain on the individual fingers of the hand of the user.

Figure 3:
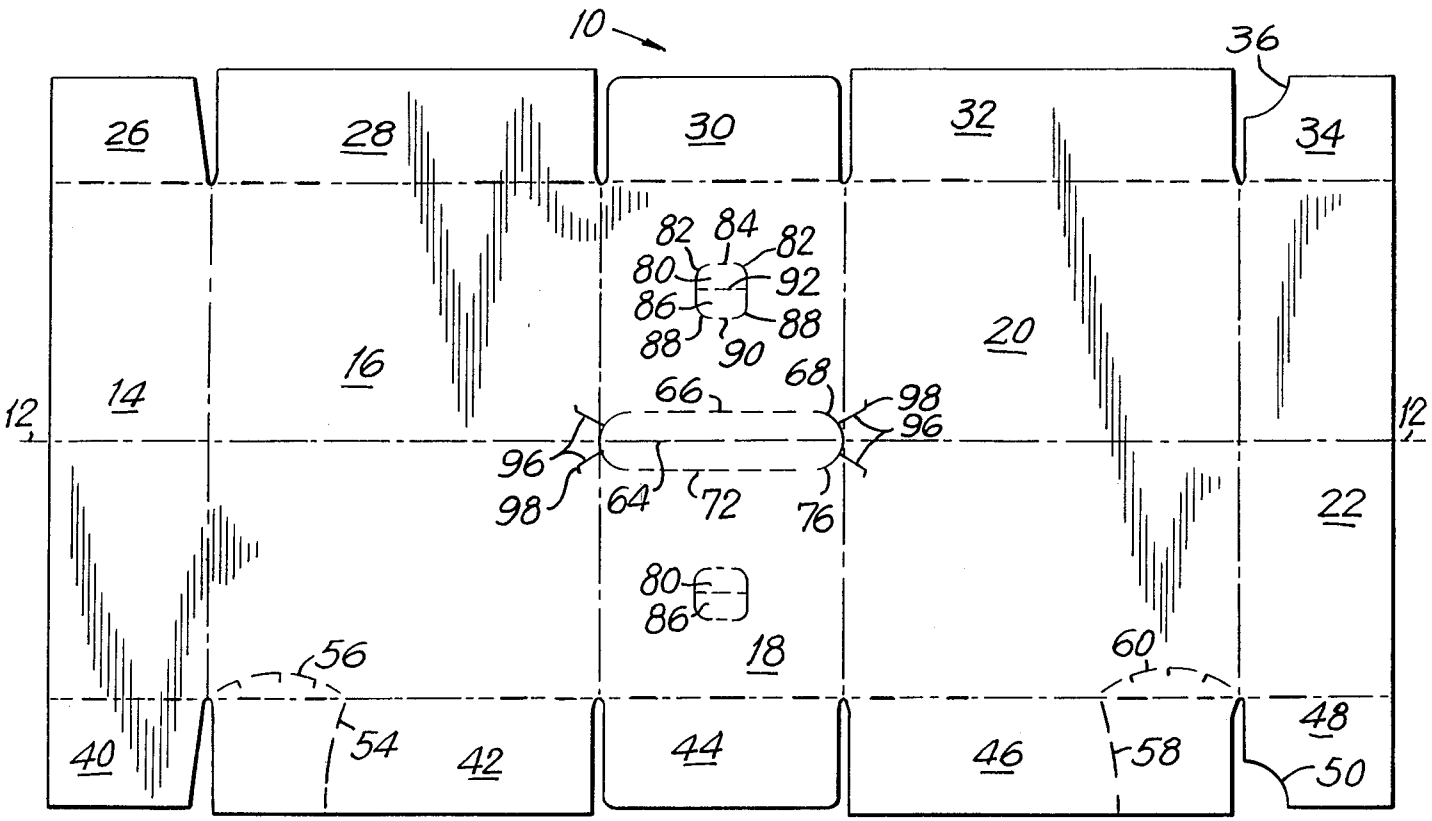
FIG. 3 is a view similar to FIG. 1 and shows a modification.

Referring now to FIG. 3 of the drawings, a modification is shown which is the same as that described above except for the addition of certain strain-relieving lines. The numeral 96 denotes any one of four strain-relieving cut lines, one end of which terminates at a respective cut bend line 68, 70, 76 and 78. Each cut line 96 terminates at its other respective end in a portion 98, portion 98 running generally parallel to the fold line connecting panel 18 to a respective panel 16, 20. Each strain-relieving cut line 96 is at an angle of approximately 30 degrees with respect to the longitudinal axis of mirror symmetry 12, while end or terminal portions 98, from the description previously given, extending substantially normally to axis 12. The length of each of the cut lines 96, together with a respective terminal portion 98, is substantially the same as the distance between perforated line 64 and either of parallel lines 66 or 72 and needs to be no longer.

Figure 4:
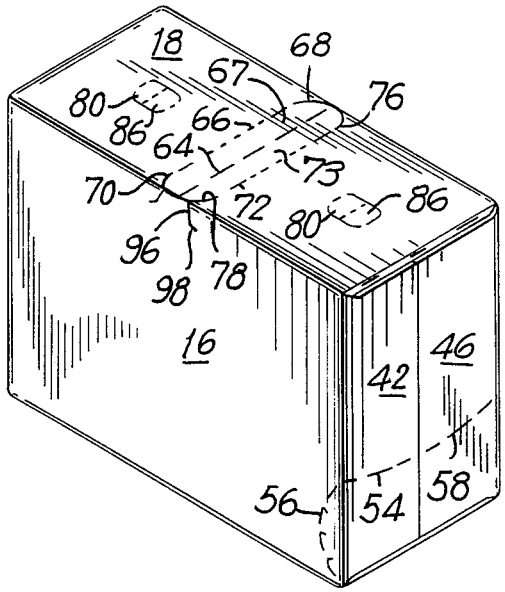
FIG. 4 is a view similar to FIG. 2 and illustrates the blank of FIG. 3 in its erected and filled condition.

FIG. 4 illustrates the erected and filled container formed from the blank of FIGS. 3, the carton being identical to that of FIG. 2 except for the presence of the strain-relieving cuts 96,98. The function of these cuts is to inhibit ripping or tearing of the carton side walls upon lifting and carrying it.

The terms upper, lower, horizontal and vertical are employed as terms of reference and not as terms of limitation.

What is claimed is:

1. A one-piece blank of stiff, resilient and foldable sheet material, such as paperboard, the blank adapted to be folded and glued to form a carton of rectangular parallelpiped form, the blank including a series of main side-forming rectangular panels foldably joined edge-to-edge along fold lines, the rectangular panels also having end-forming panels at their ends, one of said main panels being a handle panel, said handle panel having means for forming a finger opening, which means includes a finger cut line extending completely transversely across the handle panel, each end of said finger cut line terminating at a respective side edge of said handle panel, a finger perforated line parallel to the finger cutline, with each end of the finger perforated line being cut and bent so as to meet a respective end of said finger cut line at a respective fold line between said handle panel and a respective side-forming panel, to thereby define a finger flap which, when pushed orthogonally of the plane of the handle panel, will hinge about said finger perforated line to form a finger receiving recess, means for forming a thumb receiving hole on said handle panel, said thumb hole forming means being spaced from the finger opening forming means, a second finger perforated line, parallel to the first mentioned finger perforated line, the finger cut line being parallel to and between the two finger perforated lines, each end of the second finger perforated line being bent so as to meet a respective end of the finger cut line at a respective fold line between said handle panel and a respective side-forming panel, to thereby define a second finger flap which, when pushed orthogonally of the plane of the handle panel, will hinge about said second perforated line to form a finger receiving recess, a pair of strain-relieving cut lines on each side-forming panel which is foldably connected to said handle panel, one end of each cut line of each pair extending to and on said handle panel and substantially orthogonally intersecting a respective cut and bent portion of a respective finger perforated line, the other end of each strain-relieving cut line being bent so as to be substantially parallel to the fold lines at the side edges of the handle panel, wherein two lines at the side edges of the handle panel, wherein two of the strain-relieving cut lines are on one side of the longitudinal axis of the blank and the remaining two strain-relieving cut lines are on the other side of said longitudinally axis.

2. A carton formed of stiff, resilient and bendable sheet material, such as paperboard, the carton being in the general form of a rectangular parallelpiped having main, side-forming walls to define horizontal upper and lower walls and vertical side walls and also having vertical end walls, the horizontal upper wall being a handle wall, the handle wall having a finger cut line extending completely transversely across said handle panel and whose ends terminate at respective side walls, a pair of parallel, perforated finger lines between which the finger cut line passes and is parallel to, each end of each perforated finger line being bent so as to meet a respective end of the finger cut line on said handle panel so as to thereby define a pair of finger flaps which define a finger receiving opening when either or both of them is pushed inwardly towards the carton interior by the fingers, a pair of thumb hole forming flaps on the handle panel with each of the thumb hole forming flaps being on an opposite side of the finger cutline, whereby the carton can be lifted by both the fingers and the thumb of one hand of a user to thereby yield two lifting areas, a pair of strain-relieving cuts on each of the vertical side wall said stress-relieving cuts each making an angle of about 30 degrees from the vertical, the upper end of each said cut lines terminating on said handle panel and intersecting a respective bent line of the perforated finger lines, the lower end of each stress-relieving cut terminating in a substantially horizontally extending portion.

3. A one-piece blank of stiff, resilient and foldable sheet material, such as paperboard, the blank adapted to be folded and glued to form a carton of rectangular parallelpiped form, the blank including a series of main side-forming rectangular panels foldably joined edge-to-edge along fold lines, the rectangular panels also having end-forming panels at their ends, one of said main panels being a handle panel, said handle panel having means for forming a finger opening, which means includes a finger cut line extending completely transversely across the handle panel, each end of said finger cut line terminating at a respective side edge of said handle panel, a finger perforated line parallel to the finger cutline, with each end of the finger perforated line being cut and bent so as to meet a respective end of said finger cut line at a respective fold line between said handle panel and a respective side-forming panel, to thereby define a finger flap which, when pushed orthogonally of the plane of the handle panel, will hinge about said finger perforated line to form a finger receiving recess, means for forming a thumb receiving hole on said handle panel, said thumb hole forming means being spaced from the finger opening forming means, a strain-relieving cut line on each side-forming panel which is foldably connected to said handle panel, one end of each cut line extending to and on said handle panel and substantially orthogonally intersecting a respective cut and bent portion of a respective finger perforated line the other end of each strain-relieving cut line being bent so as to be substantially parallel to the fold lines at the side edges of the handle panel, each strain-relieving cut line located on one side of the longitudinal axis of the blank.

* * * * *